US006559815B1

(12) United States Patent
Kang et al.

(10) Patent No.: US 6,559,815 B1
(45) Date of Patent: May 6, 2003

(54) PLASMA DISPLAY PANEL WITH IMPROVED RECOVERY ENERGY EFFICIENCY AND DRIVING METHOD THEREOF

(75) Inventors: Kyoung-Ho Kang, Asan (KR); Jeong-Duk Ryeom, Cheonan (KR); Seong-charn Lee, Seoul (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 391 days.

(21) Appl. No.: 09/604,925

(22) Filed: Jun. 28, 2000

(30) Foreign Application Priority Data

Jun. 30, 1999 (KR) ..... 99-25805

(51) Int. Cl.[7] ..... G09G 3/28
(52) U.S. Cl. ..... 345/60; 345/209
(58) Field of Search ..... 345/60–70, 209, 345/207–208, 94–96; 315/169.1, 169.3

(56) References Cited

U.S. PATENT DOCUMENTS

| | | | | |
|---|---|---|---|---|
| 3,996,490 A | | 12/1976 | Miller | 313/217 |
| 5,369,338 A | * | 11/1994 | Kim | 315/169.1 |
| 6,144,349 A | * | 11/2000 | Awata et al. | 345/67 |
| 6,356,261 B1 | * | 3/2002 | Kim | 345/200 |

FOREIGN PATENT DOCUMENTS

| | | |
|---|---|---|
| EP | 0 762 373 A1 | 3/1997 |
| EP | 0 896 316 A1 | 2/1999 |
| JP | 5-290742 | 11/1993 |
| JP | 6314066 | 11/1994 |
| JP | 6-314066 | 11/1994 |
| JP | 8160877 | 6/1996 |

* cited by examiner

*Primary Examiner*—Lun-Yi Lao
(74) *Attorney, Agent, or Firm*—Lowe Hauptman Gilman & Berner, LLP

(57) ABSTRACT

There are provided a plasma display panel (PDP) with improved energy recovery efficiency by which EMI generated at the PDP can be offset by an electrical field generated during a sustained discharge, the number of terminals connected to common electrodes can be reduced by minimizing the current flowing through the common electrodes without applying a voltage to the common electrodes during the sustained discharge, and the PDP can be tiled by minimizing the non-luminous area of the PDP, and a driving method thereof. In the PDP with improved energy recovery efficiency, connection terminals between scanning/common electrodes and external driving circuits are formed only at a non-luminous area at one end of a front glass substrate of a three-electrode face discharge PDP, with the non-luminous area of the other end greatly reduced, positive and negative discharge sustain pulses are alternately applied to an even-numbered scanning electrode and an odd-numbered scanning electrode, both electrodes are adjacent to each other, thereby suppressing an increase in impedance caused by the non-luminous area.

3 Claims, 12 Drawing Sheets

PLASMA DISPLAY PANEL WITH IMPROVED RECOVERY ENERGY EFFICIENCY AND DRIVING METHOD THEREOF

BACKGROUND OF THE INVENTION

1. Field of the Invention

The present invention relates to a plasma display panel (PDP) with improved energy recovery efficiency, and a driving method thereof.

2. Description of the Related Art

A PDP is a display device for restoring image data input as an electrical signal by arranging a plurality of discharge tubes in a matrix to selectively emit light. PDPs are largely classified into direct current (DC) type PDPs and alternating current (AC) type PDPs according to whether the polarity of the voltage applied for sustaining a discharge changes or not over time.

FIG. 1 shows the basic structure of a general AC face discharge PDP. Referring to FIG. 1, a discharge space 15 is formed between a front glass substrate 11 and a rear glass substrate 17. In the AC face discharge PDP, a discharge sustaining electrode 12 is covered by a dielectric layer 13 so as to be electrically isolated from the discharge space 15. In this case, a discharge is sustained by the well-known wall charge effect. The above-described face discharge PDP includes two parallel discharge sustaining electrodes 12 formed on the front substrate 11 and an address electrode 16 formed on the rear substrate 17 so as to be orthogonal to the discharge sustaining electrodes 12. According to this structure, an address discharge in which a pixel is selected occurs between the address electrode 16 and the discharge sustaining electrodes 12, and then a sustained discharge in which a video signal is displayed occurs between the two discharge sustaining electrodes 12, that is, between a common (X) electrode 12*a* and a scanning (Y) electrode 12*b*.

FIG. 2 is an exploded perspective view schematically illustrating a generally used AC three-electrode face discharge PDP, in which an address electrode 16 and a pair of discharge sustaining electrodes 12*a* and 12*b* perpendicular to the address electrode 16 are installed for each discharge space 15 which is divided by partitions 18 formed on a rear substrate 17. The partitions 18 serve to block space charges and ultraviolet rays produced during a discharge, to thus prevent cross talk from being generated at neighboring pixels, as well as to form the discharge spaces 15. In order for a PDP to operate as a color display device, fluorescent material layers 19 made of a fluorescent material excited by the ultraviolet rays produced during discharge and having red (R), green (G) and blue (B) visible ray emitting characteristics, for displaying R, G and B colors, are sequentially coated in the discharge spaces 15 in order, thereby displaying R, G and B colors.

In order for a fluorescent-material-coated PDP to be capable of operating as a color video display device, a gray scale display must be utilized. Currently, a gray scale display method in which a picture of one frame is divided into a plurality of sub-fields to then be driven in a time-division manner is widely used.

FIG. 3 shows a gray scale display method in a general AC PDP. As shown in FIG. 3, in the gray scale display method of a general AC PDP, a picture of one frame is divided into a plurality of sub-fields each consisting of address periods and sustained discharge periods. Here, a 6-bit gray scale implementation method, for example, is explained. A picture of a frame is temporally divided into six sub-fields and 64 ($=2^6$) gray scales are displayed. Each sub-field consists of address periods A1–A6 and sustained discharge periods S1–S6. Gray scales are displayed using a principle in which the comparative lengths of the sustained discharge periods are expressed visually in the brightness ratio. In other words, since the lengths of the sustained discharge periods S1 to S6 of the first sub-field (SF1) to the sixth sub-field (SF6) comply with a ratio of 1:2:4:8:16:32, altogether, 64 types of sustained discharge periods, that is, 0, 1(1T), 2(2T), 3(1T+2T), 4(4T), 5(1T+4T), 6(2T+4T), 7(1T+2T+4T), 8(8T), 9(1T+8T), 10(2T+8T), 11(3T+8T), 12(4T+8T), 13(1T+4T+8T), 14(2T+4T+8T), 15(1T+2T+4T+8T), 16(16T), 17(1T+16T), 18(2T+16T), . . . , 62(2T+4T+8T+16T+32T) and 63(1T+2T+4T+8T+16T+32T) are constituted, thereby displaying 64 gray scale levels. For example, in order to display a gray scale level of 6 at an arbitrary pixel, only the second sub-field (2T) and the third sub-field (4T) have to be addressed. Also, in order to display a gray scale level of 15, all of the first through fourth sub-fields have to be addressed.

FIG. 4 is a layout diagram of electrodes of an AC face discharge PDP constructed for implementation of the gray scale display method shown in FIG. 3. Here, among the discharge sustaining electrodes 12, consisting of paired horizontal electrodes, the interconnected electrodes are common electrodes (X-electrodes) 12*a* and the other side electrodes are scanning electrodes (Y-electrodes) 12*b*. The common electrodes (X-electrodes) 12*a* are all connected together, and a voltage signal, including a discharge sustain pulse, is applied thereto. Thus, a scanning signal is applied to the scanning electrodes, that is, the Y-electrodes 12*b*, so that addressing is done between the Y-electrodes 12*b* and the address electrodes 6, and the discharge sustain pulse is applied between the Y-electrodes 12*b* and the X-electrodes 12*a* so that a display discharge is sustained. Waveforms of the driving signals applied to the respective electrodes connected as above are shown in FIG. 5.

FIG. 5 is a diagram showing the waveforms of driving signals of a generally used AC PDP, in which a picture display is implemented by an address/display separation (ADS) driving method. In FIG. 5, reference mark A denotes a driving signal applied to address electrodes, reference mark X denotes a driving signal applied to the common electrodes (to be also referred to as X-electrodes) 12*a*, and reference marks Y1 through Y480 denote driving signals applied to the respective Y-electrodes 12*b*. During a total erase period A11 a total erase pulse 22*a* is applied to the common (X) electrodes 12*a* for an accurate gray scale display to cause a strong discharge, thereby erasing wall charges generated by a previous discharge to promote the operation of the next sub-field (step 1). Next, during a total write period A12 and a total erase period A13, in order to reduce an address pulse voltage 21, a total write pulse 23 is applied to the Y-electrodes 12*b* and a total erase pulse 22*b* is applied to the X-electrodes 12*a* to cause a total write discharge and a total erase discharge, respectively, thereby controlling the amount of wall charges accumulated in the discharge space 15 (steps 2 and 3). Then, during an address period A14, data converted into an electrical signal is written on a selected location on the whole screen of the PDP by a selective discharge using the address pulse (data pulse) 21 and a write pulse 24 between the address electrode 16 and the scanning electrode 12*b* intersecting each other (step 4). Next, during a sustained discharge period S1, a display discharge, which is caused by continuously applying the discharge sustain pulse 25, is sustained for a given period of time, for the purpose of displaying picture data on the screen.

As shown, as the number of scanning lines increases, the time required for a write operation increases and the number of sub-fields increases so that the time allocated to the sustain discharge is reduced. Thus, a panel having a higher resolution has a lesser overall luminance. That is, for a high-resolution display, luminance degradation cannot be avoided.

FIG. 6 is a schematic perspective plan view illustrating the structure of a conventional three-electrode face discharge PDP. As described above, an address electrode 16 is formed on a rear glass substrate 17, and the address electrode 16 extends to either the top or bottom edges of, or to both the top and bottom edges of the rear glass substrate 17. The address electrode 16 is generally connected to an address driving board (not shown) using a flexible printed circuit (FPC). Scanning electrodes 12*b* and common electrodes 12*a* for a sustained discharge extend to both sides of the front glass substrate 11. The common electrodes 12*a* may be internally connected or may be connected on a driving board so as to be operable together. In order for terminals to extend outside to be connected, as shown in FIG. 6, an area corresponding to a predetermined space cannot contribute to a discharge. In FIG. 6, areas 20 indicated by dotted lines are non-luminous areas. The rear glass substrate 12 having the address electrode 16 has a non-luminous area narrower than the front glass substrate 11.

FIG. 7 illustrates the flow of current generated when the PDP undergoes a sustained discharge. During a sustained discharge, a voltage exceeding a minimum sustained discharge causing voltage is abruptly applied to scanning electrodes or common electrodes. Thus, current flows throughout a driving board 60, a frame 50 and a panel 40 just like a temporary solenoid. An electrical field is formed due to such a current flow, thereby causing electromagnetic interference (EMI).

SUMMARY OF THE INVENTION

To solve the above problems, it is an object of the present invention to provide a plasma display panel (PDP) with improved energy recovery efficiency by which EMI generated at the PDP can be offset by an electrical field generated during a sustained discharge, the number of terminals connected to common electrodes can be reduced by minimizing the current flowing in the common electrodes without applying a voltage to the common electrodes during a sustained discharge, the PDP can be tiled by minimizing the non-luminous area of the PDP, and a driving method thereof.

Accordingly, to achieve the above object, there is provided a PDP having front and rear substrates opposed to and spaced apart from each other to maintain a discharge space, discharge sustaining electrodes having pairs of parallel, striped scanning lines and common lines on the front substrate, address electrodes arranged on the rear substrate orthogonally to the discharge sustaining electrodes, and a frit portion for hermetically sealing edges of the front and rear substrates, wherein a common connection line for connecting the common electrodes with each other is formed at a periphery at one end of the front substrate, the common connection line by-passes the discharge sustaining electrodes to extend to the exposed portions of the other ends of the front substrate, in which external connection terminals, where the scanning electrodes are connected to the outside, are formed, and external connection terminals, where the common electrodes are connected to the outside, are formed at the exposed portions of the other ends of the front substrate.

Also, in the present invention, the common connection line is preferably formed at a location corresponding to the frit portion to be wider than each of the common electrodes, and the address electrodes preferably have connection terminals formed only at the exposed portions of a periphery at one end of the rear substrate.

Also, according to another aspect of the present invention, there is provided a PDP having front and rear substrates opposed to and spaced apart from each other to maintain a discharge space, discharge sustaining electrodes having pairs of parallel, striped scanning lines and common lines on the front substrate, and address electrodes arranged on the rear substrate orthogonally to the discharge sustaining electrodes, wherein external connection terminals, where the scanning and common electrodes are connected to the outside, are formed only at the exposed portions of the one-end periphery of the front substrate.

In the present invention, the external connection terminals are preferably arranged at the exposed portions of a periphery at one end of the front substrate such that they alternately connect the scanning electrodes and the common electrodes, and the address electrodes preferably have connection terminals for being connected to the outside, formed only at a periphery at one end of the rear substrate.

Alternatively, the present invention provides a PDP having front and rear substrates opposed to and spaced apart from each other to maintain a discharge space, discharge sustaining electrodes having pairs of parallel, striped scanning lines and common lines on the front substrate, address electrodes arranged on the rear substrate orthogonally to the discharge sustaining electrodes, and a frit portion for hermetically sealing edges of the front and rear substrates, wherein a common connection line for connecting the common electrodes to each other is formed at a periphery at one end of the front substrate, and external connection terminals, where a plurality of common electrodes constituting an electrode group are simultaneously connected to the outside, the extending connection terminals extending from each of the plurality of common electrodes, are formed at the exposed portions of the other ends of the front substrate, at which the external connection terminals where the scanning electrodes are connected to the outside, are formed.

In the present invention, the common connection line is preferably formed at a location corresponding to the frit portion to be wider than each of the common electrodes, and the address electrodes preferably have connection terminals formed only at the exposed portions of the one-end periphery of the rear substrate.

Also, the present invention provides a method of driving a PDP having front and rear substrates opposed to and spaced apart from each other to maintain a discharge space, discharge sustaining electrodes having pairs of parallel, striped scanning lines and common lines on the front substrate, address electrodes arranged on the rear substrate orthogonally to the discharge sustaining electrodes, and a frit portion for hermetically sealing edges of the front and rear substrates, wherein a common connection line for connecting the common electrodes to each other is formed at a periphery at one end of the front substrate, and external connection terminals, where a plurality of common electrodes constituting an electrode group are simultaneously connected to the outside, the extending connection terminals extending from each of the plurality of common electrodes, are formed at the exposed portions of the other ends of the front substrate, at which the external connection terminals where the scanning electrodes are connected to the outside, are formed, the method comprising the step of driving the scanning electrodes by each two adjacent lines, wherein positive and negative discharge sustain pulses are alternately applied to two even-numbered driven lines, and a discharge sustain pulse having an opposite polarity to the two even-numbered driven lines is applied to two odd-numbered driven lines in synchronization with the discharge sustain pulses applied to the two even-numbered driven lines.

In the present invention, when a sustained discharge is performed by the two even-numbered driven lines and the two odd-numbered driven lines, a difference in the potential therebetween is preferably 2 times the voltage of the discharge sustain pulse, and the potential of the common electrodes is preferably an intermediate level of the voltages of the discharge sustain pulses applied to the two even-numbered driven lines and the two odd-numbered driven lines.

BRIEF DESCRIPTION OF THE DRAWINGS

The above objects and advantages of the present invention will become more apparent by describing in detail preferred embodiments thereof with reference to the attached drawings in which.

DESCRIPTION OF THE PREFERRED EMBODIMENTS

Figure 1:
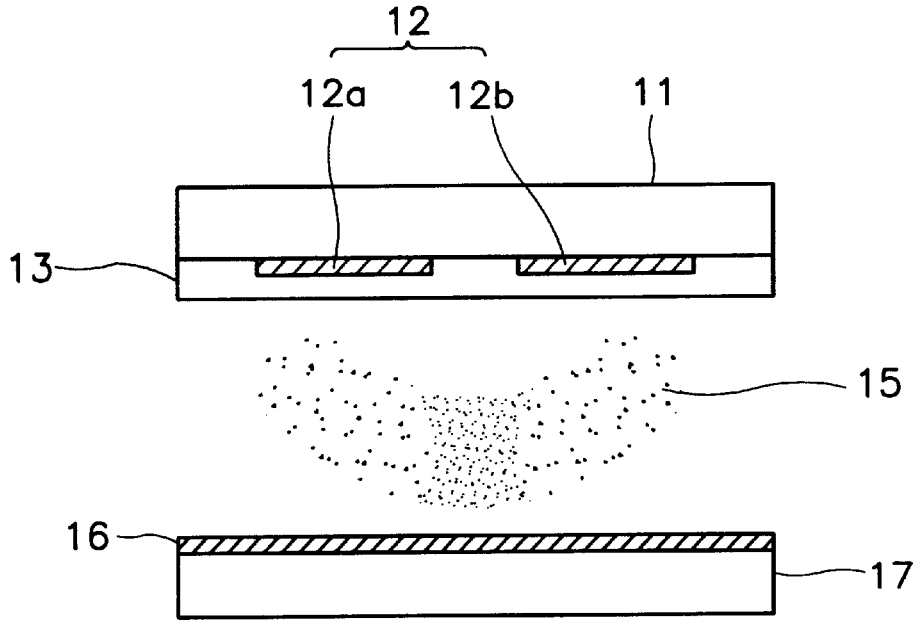
FIG. 1 is a vertical section view illustrating the basic structure of a general alternating-current (AC) face discharge plasma display panel (PDP)
Figure 2:
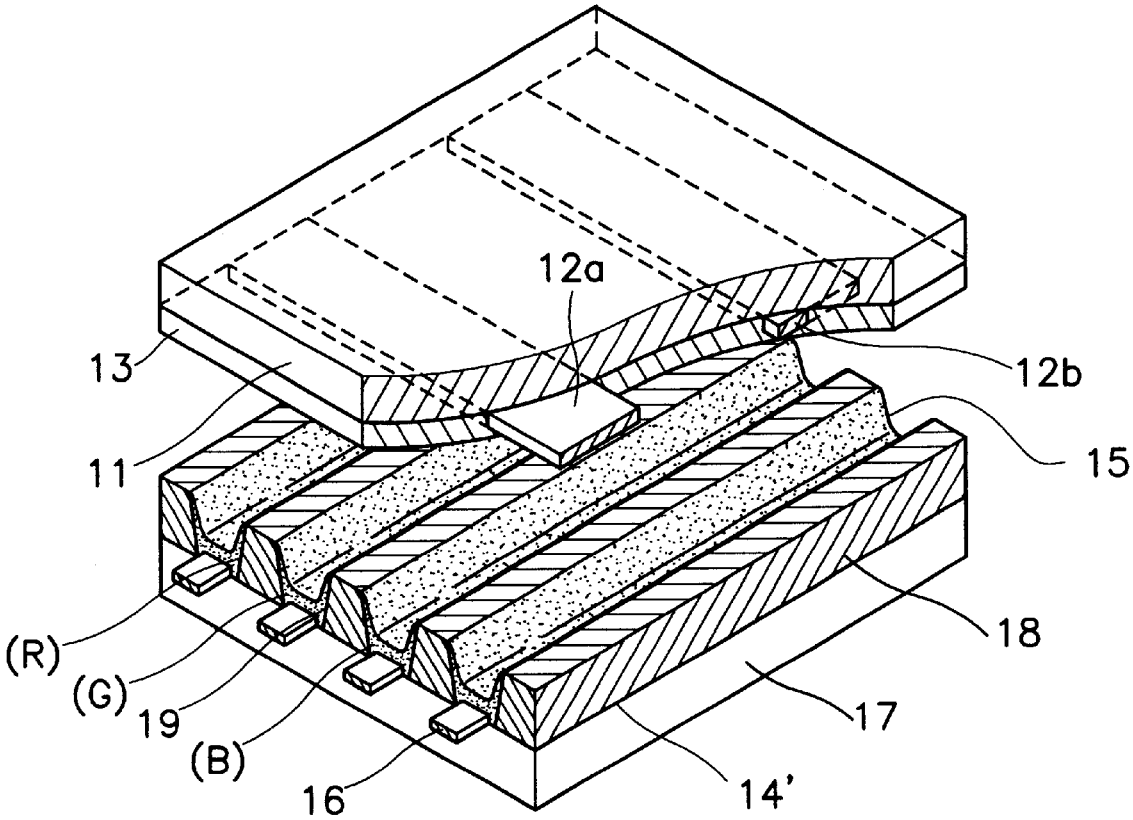
FIG. 2 is an exploded perspective view schematically illustrating the AC three-electrode face discharge PDP shown in FIG. 1.
Figure 3:
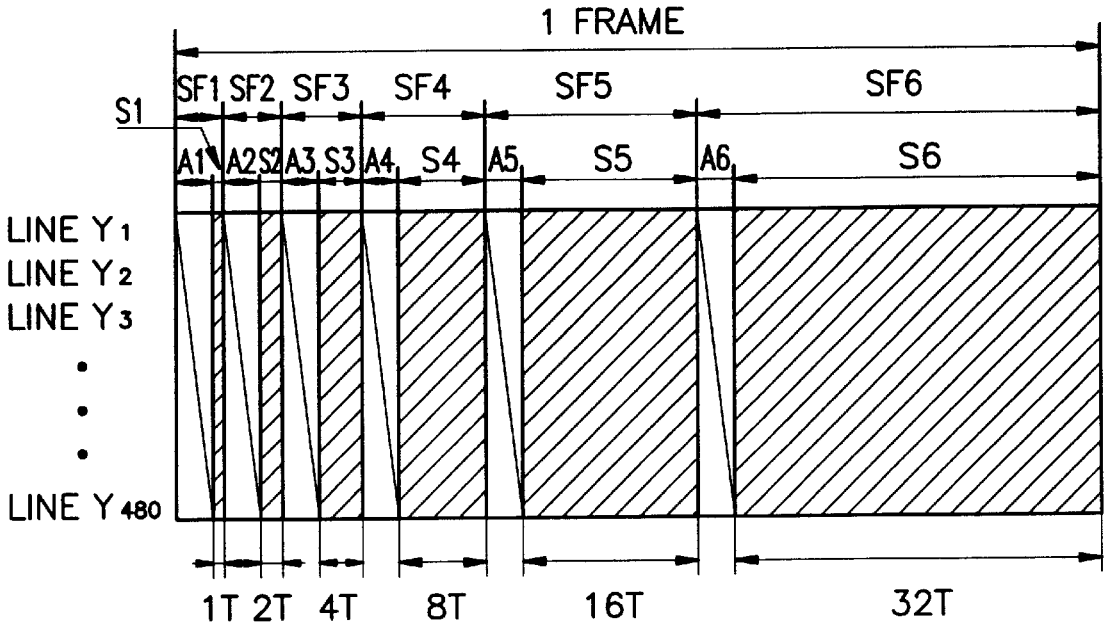
FIG. 3 illustrates a gray scale display method of the AC three-electrode face discharge PDP shown in FIG. 2.
Figure 4:
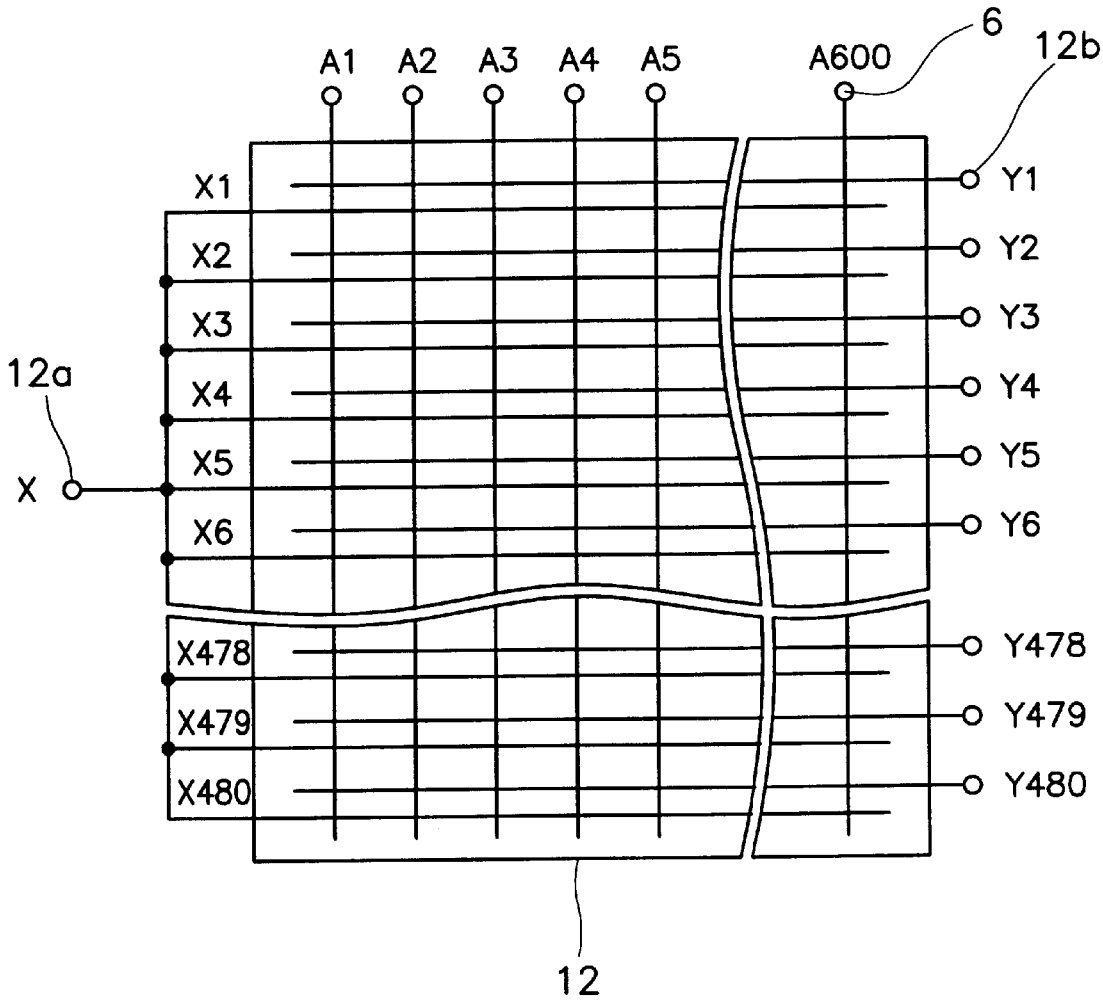
FIG. 4 is a layout diagram of the AC three-electrode face discharge PDP shown in FIG. 2, constructed for implementation of the gray scale display method shown in FIG. 3.
Figure 5:
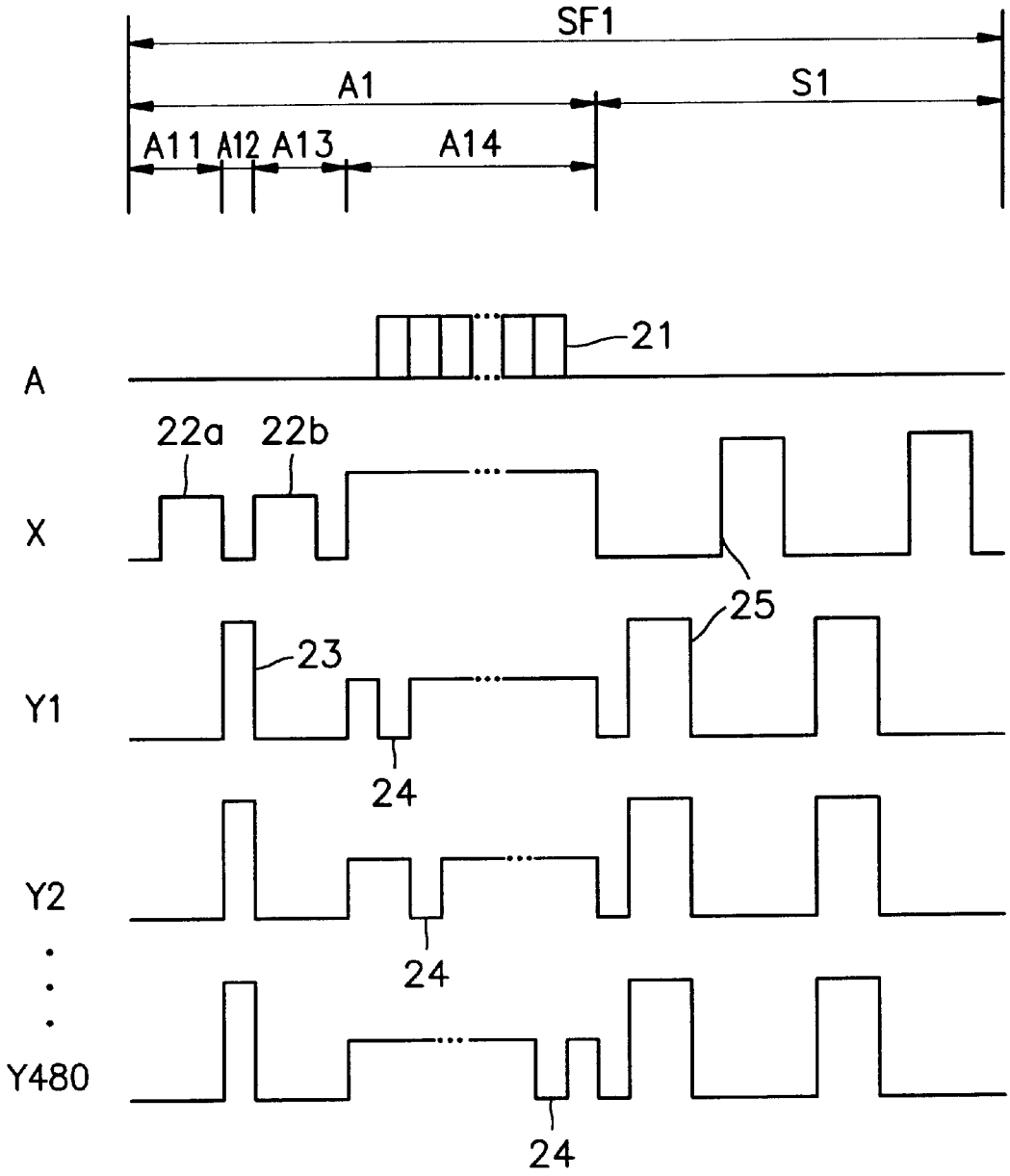
FIG. 5 is a diagram showing waveforms of driving signals applied to the respective electrodes shown in FIG. 4.
Figure 6:
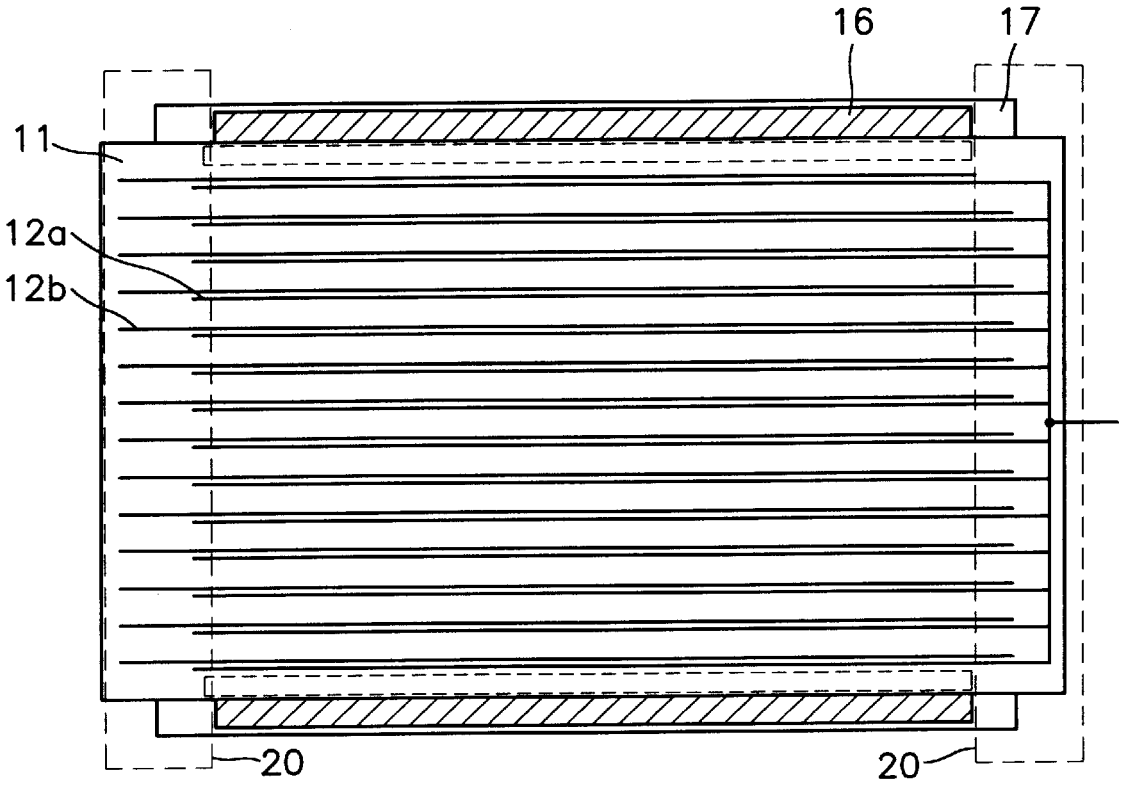
FIG. 6 (PRIOR ART)
FIG. 6 is a schematic perspective plan view illustrating a conventional three-electrode face discharge PDP.
Figure 7:
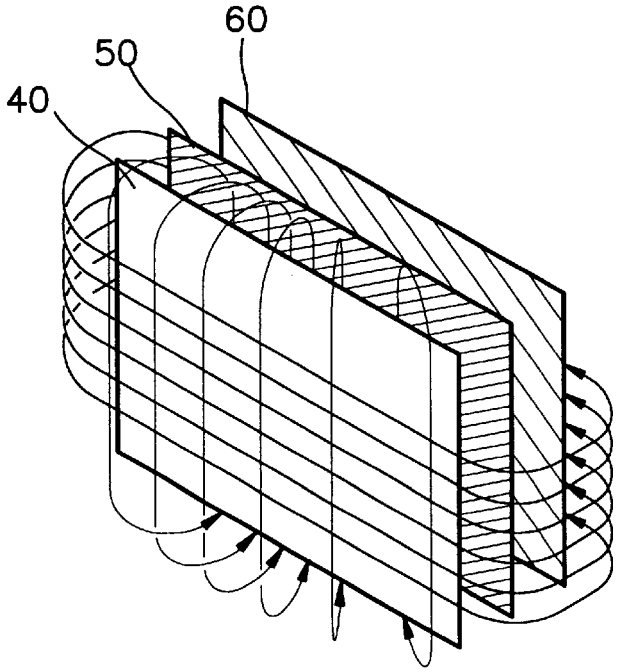
FIG. 7 (PRIOR ART)
FIG. 7 illustrates the flow of current generated when a PDP undergoes a sustained discharge.

A plasma display panel with improved energy recovery efficiency and a driving method thereof will now be described in detail with reference to the accompanying drawings.

In the PDP with improved energy recovery efficiency according to the present invention, the energy recovery efficiency can be improved by changing the electrode structure and applying an appropriate discharge sustain pulse for the changed electrode structure. To this end, during a sustained discharge of the PDP, the directions of current flowing through alternate lines are made to be opposite to each other so that adjacent electromagnetic fields offset each other, thereby suppressing unnecessary electromagnetic fields generated throughout the operating panel. If a sustained discharge is performed in such a manner, discharge sustain pulses are applied such that the directions of wall charges in two adjacent lines are opposite to each other. Thus, equivalent capacitance in view of an electrode driver side is reduced to half, thereby increasing the energy recovery efficiency. Also, to this end, wiring by which common electrodes and scanning electrodes are connected to external driving circuits, is formed such that an exposed portion is formed only at one edge of a front glass substrate, rather than at both edges thereof. Further, the common electrodes are connected at one end by a common connection line by-passing the scanning electrodes, and a plurality of common electrodes are grouped as common electrode block. Then, in each common electrode block, a connection terminal extending from all common electrodes to be connected to external driving circuits through the common connection line are provided at the exposed portions of the other (non-interconnected) end of the common electrode on the front glass substrate, in which the connection terminals of the scanning electrodes to be connected to external driving circuits are formed, so that a minimum amount of current flows in the common electrodes and most current flows in the scanning electrodes. By doing so, no interconnection is necessary at the one-side periphery of the panel. Also, at the one-side periphery of the front glass substrate, invalid portions in which a screen is not displayed can be minimized, thereby allowing tiling of the PDP.

As described above, in the PDP with improved energy recovery efficiency according to the present invention, the EMI generated during a sustained discharge is suppressed by offsetting electromagnetic fields formed during the sustained discharge between adjacent electrodes. Also, the number of terminals for being connected to the common electrodes can be reduced by applying no voltage to the common electrodes during the sustained discharge and minimizing the current flowing through the common electrodes. Further, the non-luminous area of the panel is minimized, thereby enabling tiling of the PDP.

Specific electrode structures proposed in various embodiments of a PDP according to the present invention will now be described.

Figure 8:
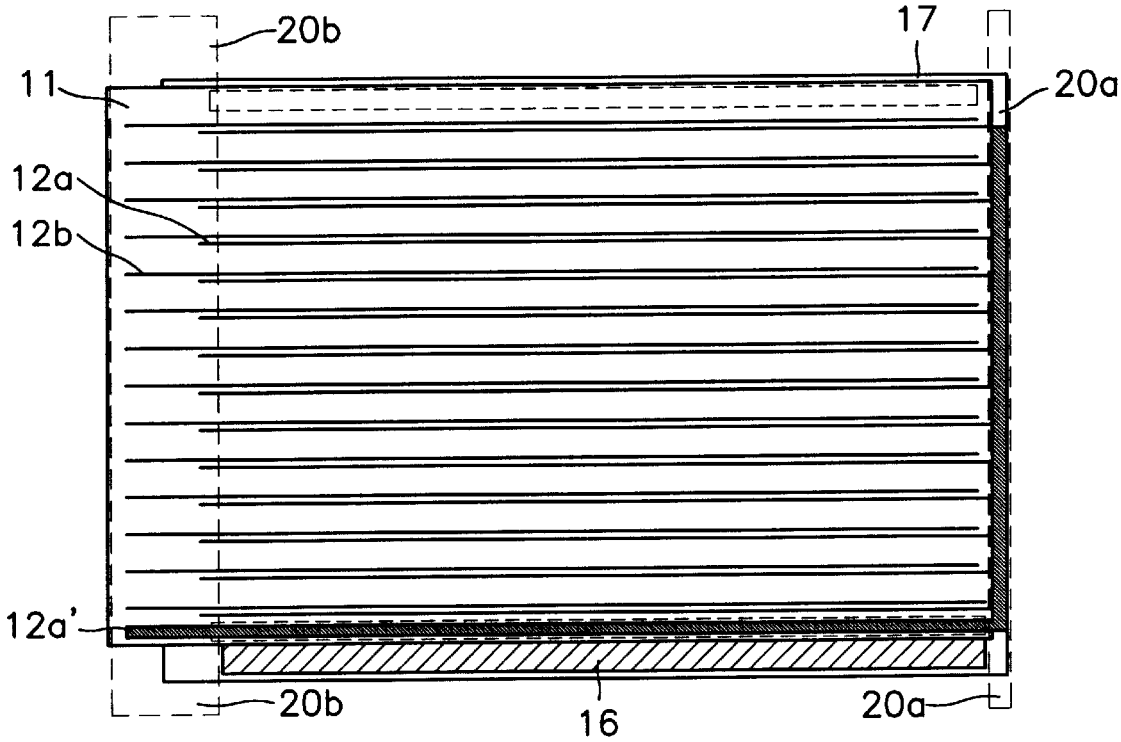
FIG. 8 is a view illustrating the structure of a PDP with improved energy recovery efficiency according to a first embodiment of the present invention.

FIG. 8 is a view illustrating the structure of a PDP with improved energy recovery efficiency according to a first embodiment of the present invention. As shown in FIG. 8, in this embodiment, one set of ends of common electrodes 12*a*, that is, right ends in the drawing, are connected together using non-luminous areas 20*a* at one end (at the right end in FIG. 8) of a front glass substrate 11. Then, an extending ground line 12*a*' of the common electrodes is formed to reach a non-luminous area 20*b* in the other end (at the left end in FIG. 8), where the scanning electrodes are connected to external driving circuits, and the common electrodes 12*a* are connected to the external driving circuits using the extending ground line 12*a*'. As described above, the ground line 12*a*' of the common electrodes 12*a* is formed at the non-luminous area along the periphery (the upper or lower end) of the front glass substrate 11, and the common electrodes are connected to external driving circuits using a non-luminous area (the non-luminous area 20*b* at the left end in FIG. 8) of the front glass substrate 11, where the scanning electrodes 12*b* are connected to external driving circuits, thereby minimizing the non-luminous area without a considerable change. However, the electrode wiring structure of this embodiment shown in FIG. 8 has little effect in offsetting the EMI.

Figure 9:
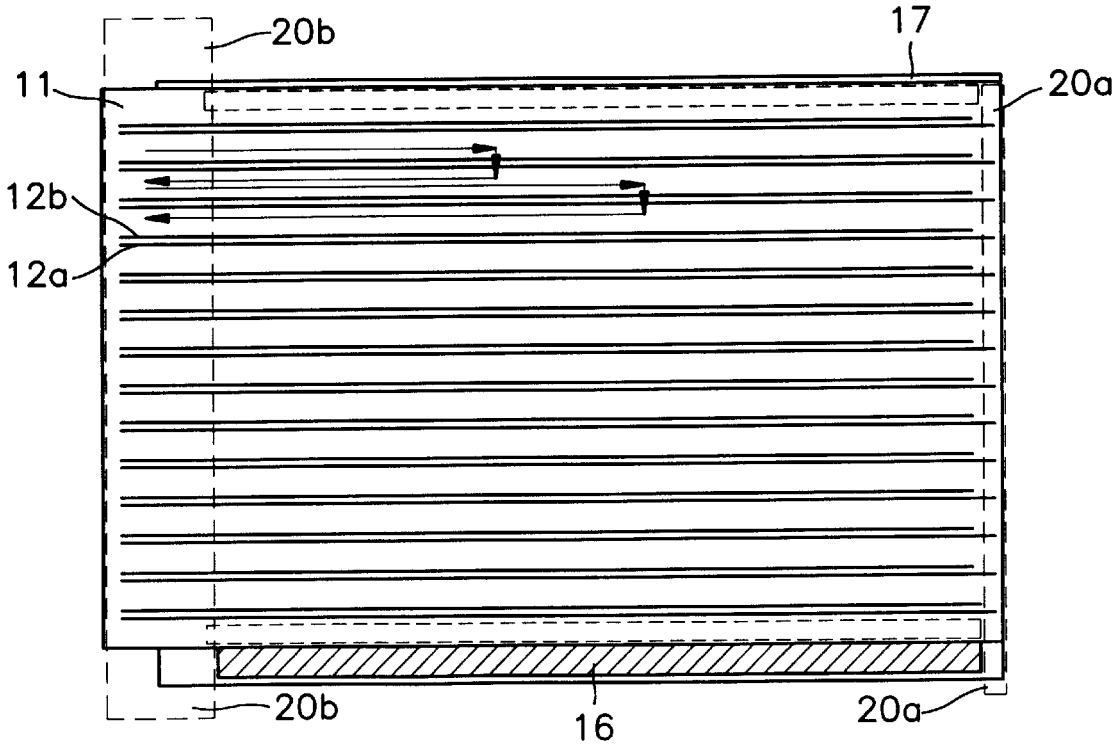
FIG. 9 is a view illustrating the structure of a PDP with improved energy recovery efficiency according to a second embodiment of the present invention.

FIG. 9 is a view illustrating the structure of a PDP with improved energy recovery efficiency according to a second embodiment of the present invention. As shown in FIG. 9, according to this embodiment, as many common electrodes as scanning electrodes are connected to external driving circuits using non-luminous area 20*b* of the front glass substrate 11. Based on this electrode wiring method, since the current flows toward common (X) electrodes through scanning (Y) electrodes at the respective discharge sustaining electrodes, the directions of current between two adjacent lines are opposite to each other. Thus, the respective discharge sustaining electrodes of the PDP form closed loops so that the directions of current between two adjacent electrodes are opposite, thereby offsetting electromagnetic fields produced thereat, resulting in reduction of EMI. However, interconnections become finer on a plane in which scanning electrodes are connected to external driving circuits and L, R and C components of each cell are different for each discharge, thereby preventing uniform discharge.

Figure 10:
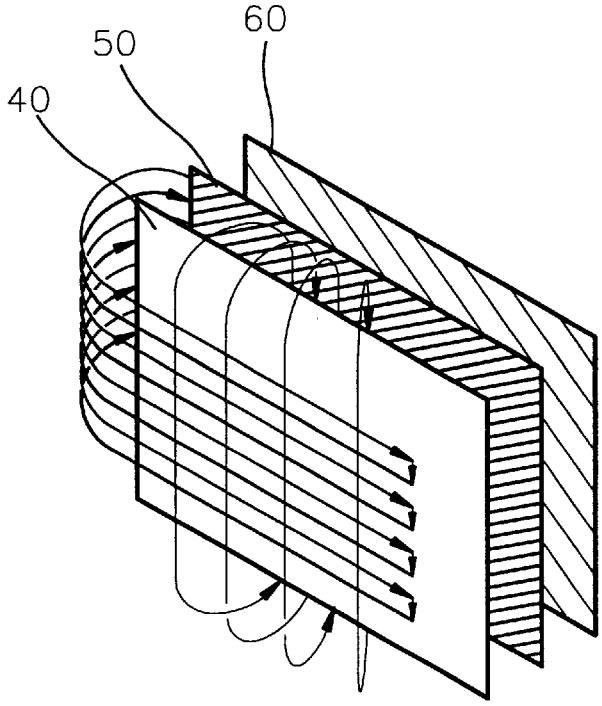
FIG. 10 illustrates the offset of EMI when the PDP shown in FIG. 9 is employed.

FIG. 10 illustrates the offset of EMI when the PDP shown in FIG. 9 is employed. In the case where a discharging cell exists in the panel, if a discharge sustain pulse for causing a discharge at the cell is applied to the cell, current flows in the reverse direction of the initial current via scanning electrodes, a discharge space (cell) and common electrodes. During this procedure, the EMI produced by the current is offset.

Figure 11:
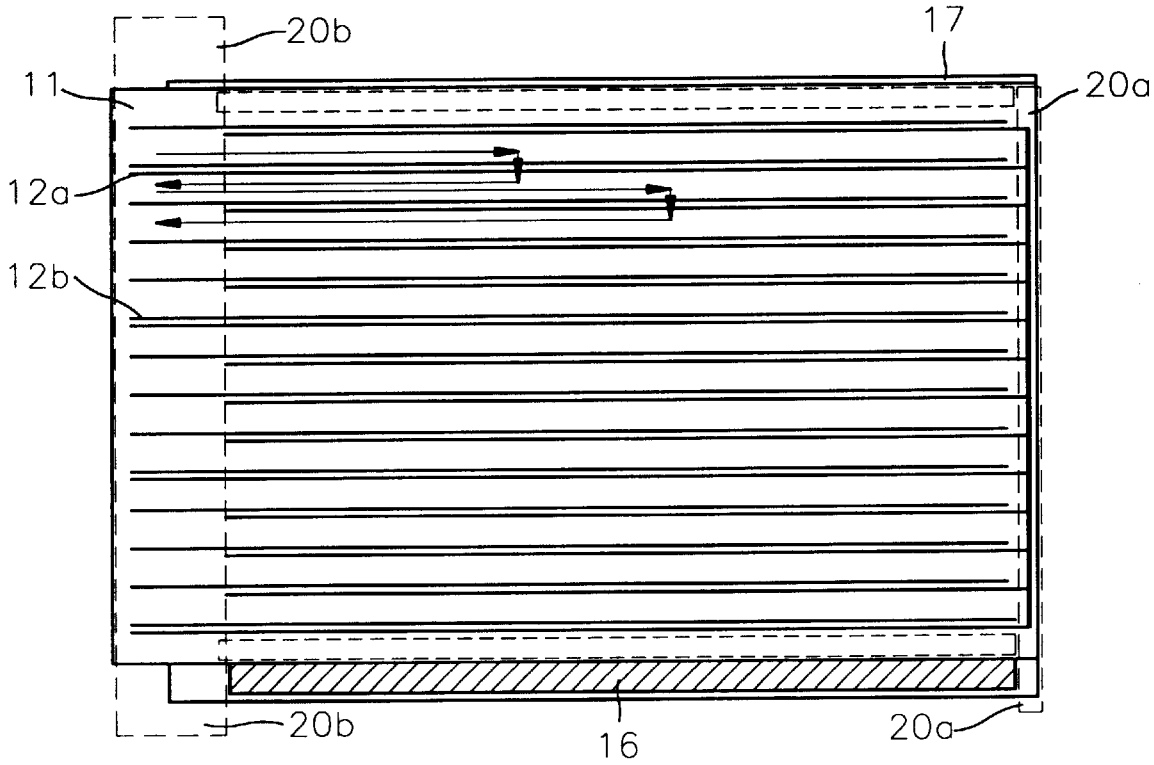
FIG. 11 is a view illustrating the structure of a PDP with improved energy recovery efficiency according to a third embodiment of the present invention.

FIG. 11 is a view illustrating the structure of a PDP with improved energy recovery efficiency according to a third embodiment of the present invention. As shown in FIG. 11, according to this embodiment, scanning electrodes extend to a non-discharge area at one end (at the left-end non-discharge area in FIG. 11) of a front glass substrate 11, and common electrodes 12*a* extend to a non-discharge area at the other end (at the right-end non-discharge area in FIG. 11) where scanning electrodes are not formed, to then be interconnected. A predetermined number of interconnected common electrodes, are grouped as a block, and one common electrode in each block is extended to the non-discharge area where scanning electrodes are connected to external driving circuits, (the left-end non-discharge area in FIG. 11). Then, the extended common electrodes are connected to the external driving circuits. Here, the number of common electrodes in each block is determined according to the amount of current instantaneously flowing through the common electrodes.

Figure 12:
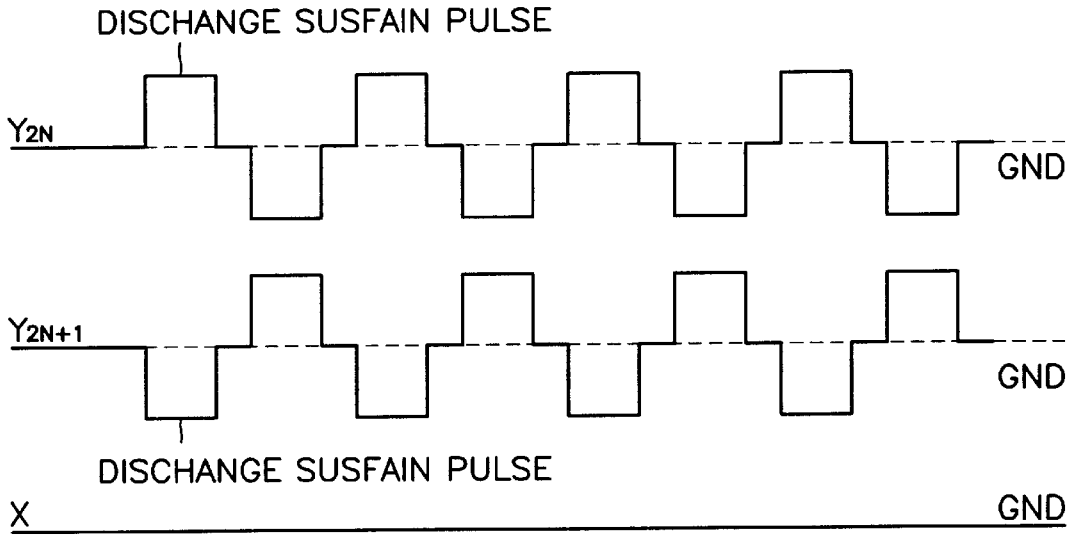
FIG. 12 is a diagram showing waveforms of driving signals applied to the discharge sustaining electrodes configured to be suitable to the structure shown in FIG. 11.

FIG. 12 is a diagram showing waveforms of driving signals (discharge sustain pulses) applied to the discharge sustaining electrodes configured to be suitable to the structure shown in FIG. 11. During a sustained discharge, discharge sustain pulses having opposite polarities are respectively applied to the odd-numbered scanning electrodes and the even-numbered scanning electrodes, with no driving signal pulse being applied to common electrodes. The waveforms of the driving signals applied to even-numbered scanning electrodes $Y_{2N}$ are such that positive and negative pulses causing a sustained discharge are alternately applied. Here, opposite- polarity pulses to those applied to the even-numbered scanning electrodes $Y_{2N}$ are alternately applied to the odd-numbered scanning electrodes $Y_{2N+1}$ in synchronization with the discharge sustain pulses of the even-numbered scanning electrodes $Y_{2N}$. Applying the driving signal waveforms in such a manner reduces an equivalent capacitance of the panel to half.

Figure 13:
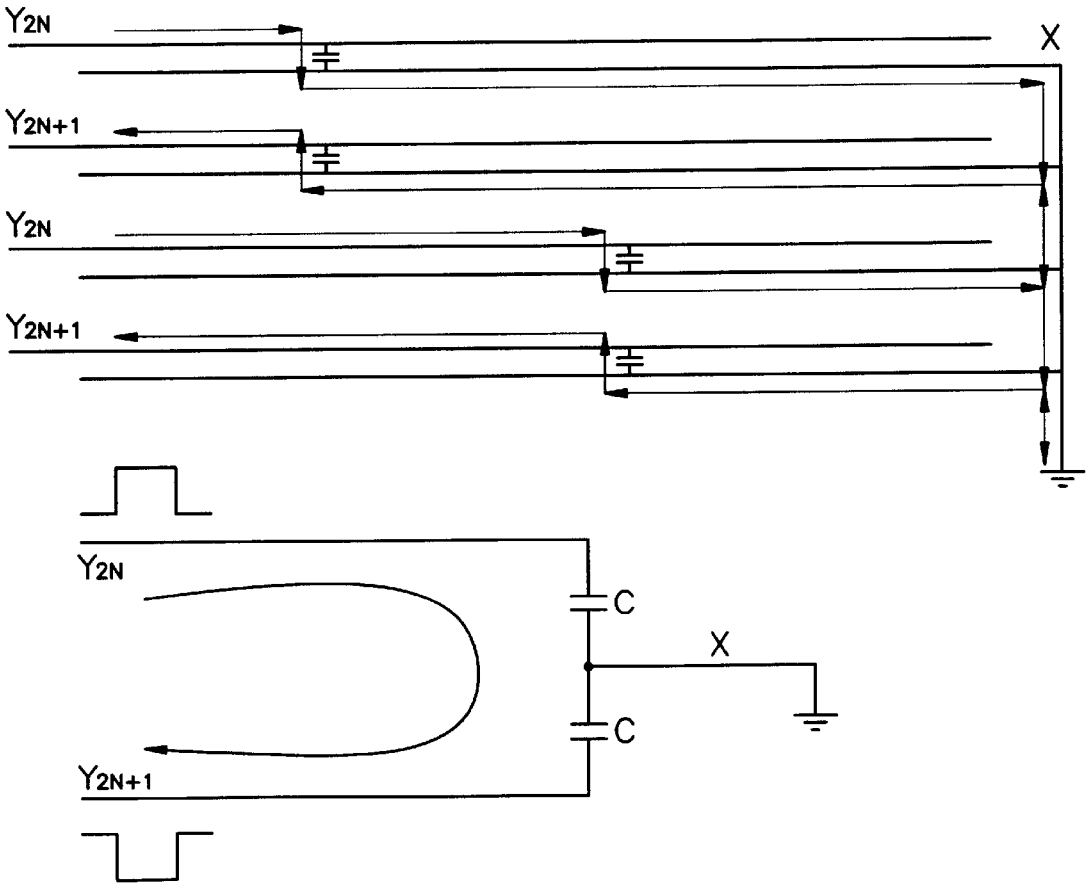
FIG. 13 illustrates the flow of current when the discharge sustain pulses having the waveforms shown in FIG. 12 are applied to scanning electrodes.

FIG. 13 illustrates the flow of current when the discharge sustain pulses having the waveforms shown in FIG. 12 are applied to scanning electrodes. If a positive pulse is applied to even-numbered scanning electrodes $Y_{2N}$, then a negative pulse is applied to the odd-numbered scanning electrodes $Y_{2N+1}$. Thus, the X-electrodes reveal no change in GND potential. Also, the equivalent capacitance equals a value obtained when the capacitance values of a line are serially connected, that is, C/2. While the sum of the capacitance values of two lines was conventionally 2C, the overall equivalent capacitance of the panel according to the present invention is reduced to one fourth (C/2) due to the serial connection of the capacitance of adjacent lines. This implies that an increase in the energy recovery efficiency can be expected in the present invention. When current flows, the same amount of capacitance exists in both the even-numbered scanning electrodes $Y_{2N}$ and the odd-number scanning electrodes $Y_{2N+1}$. However, during a discharge, because of the presence of wall charges, there is a change in capacitance between the even-numbered scanning electrodes $Y_{2N}$ and the odd-numbered scanning electrodes $Y_{2N+1}$.

In this case, if the value of forward current flowing in the even-numbered scanning electrodes $Y_{2N}$ is different from that of reverse current flowing in the odd-number scanning electrodes $Y_{2N+1}$, either forward or reverse current is supplied through the X-electrodes connected to the ground port GND. However, in most video signals, since even-numbered scanning electrodes $Y_{2N}$ and odd-number scanning electrodes $Y_{2N+1}$ have substantially the same current value, it is not necessary to supply a large amount of current to the X-electrodes. By using this driving method, the electrode structure of the PDP shown in FIG. 11 can implement a discharge smoothly.

Figure 14:
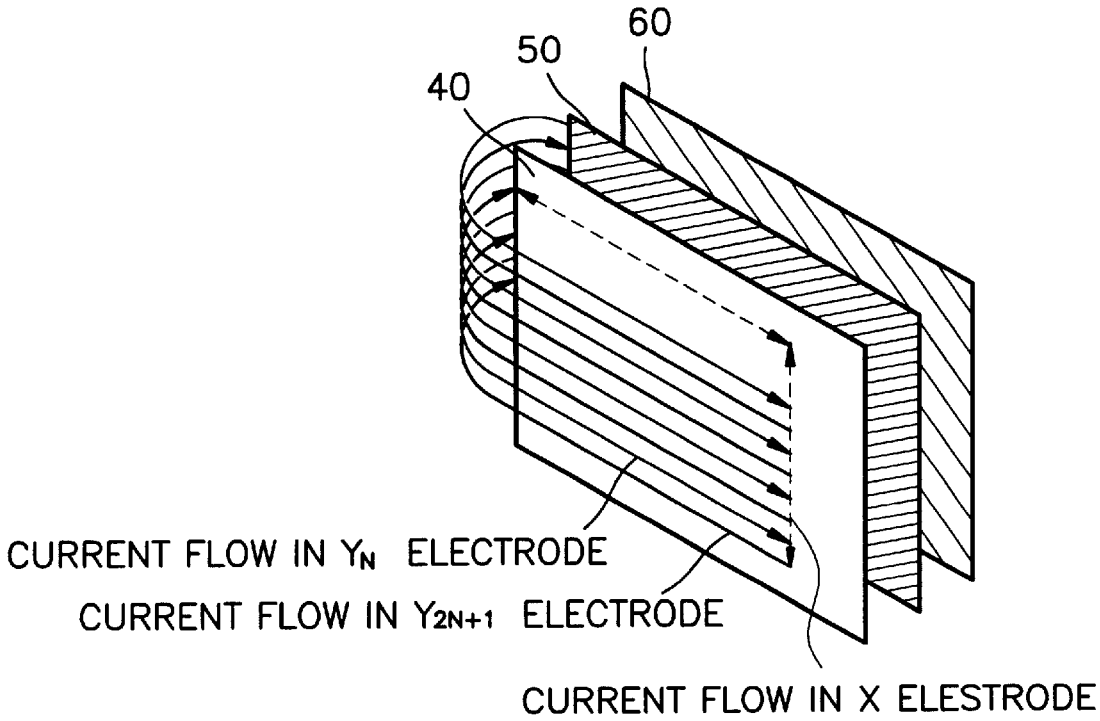
FIG. 14 illustrates the offset of EMI when the PDP shown in FIG. 11 is employed.

FIG. 14 illustrates the offset of EMI when the PDP shown in FIG. 11 is employed. As shown in the drawing, when a positive pulse is applied to even-numbered scanning electrodes $Y_{2N}$, then a negative pulse is applied to the odd-numbered scanning electrodes $Y_{2N+1}$. In this case, little current flows in the X-electrodes. Thus, closed loops of current are formed throughout a driving board 60, a frame 50 and a panel 40, in opposite directions, thereby offsetting EMI.

Figure 15:
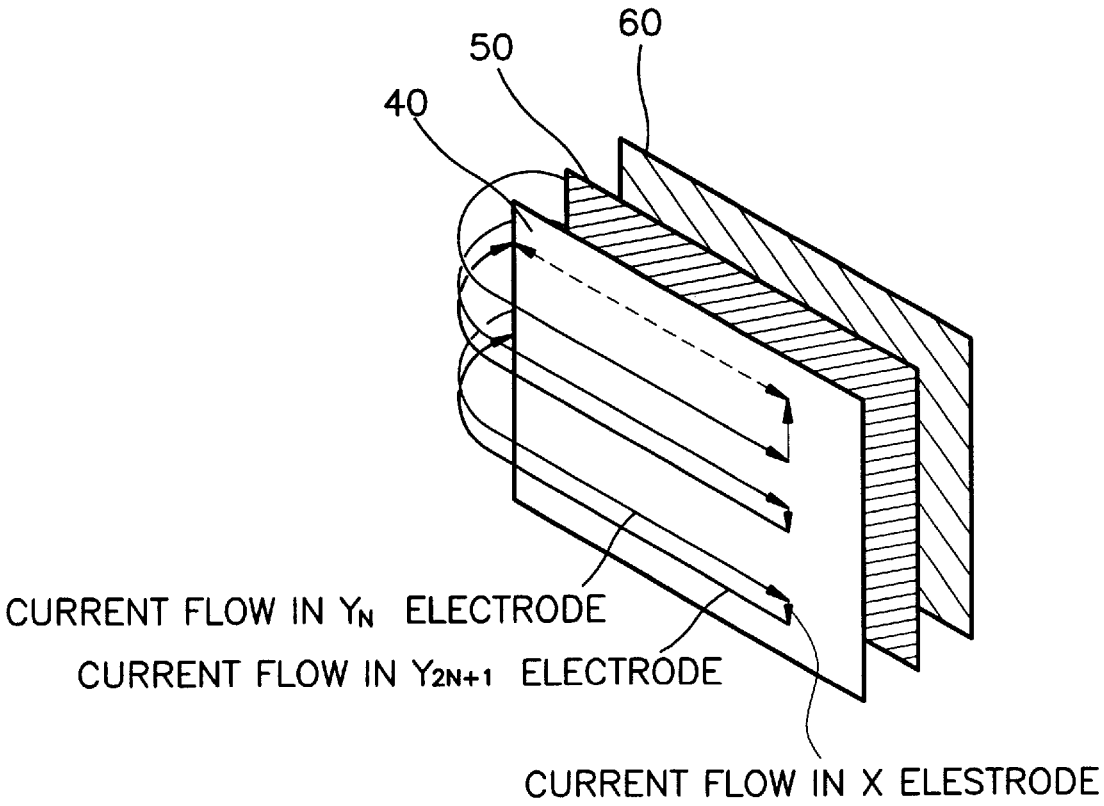
FIG. 15 illustrates the current supply/release paths in the case where the number of discharge cells of even-numbered scanning electrodes $Y_{2N}$ is different from that of odd-numbered scanning electrodes $Y_{2N+1}$, when a sustained discharge is performed in the case shown in FIG. 14.

FIG. 15 illustrates the current supply/release paths in the case where the number of discharge cells of even-numbered scanning electrodes $Y_{2N}$ is different from that of odd-numbered scanning electrodes $Y_{2N+1}$, when a sustained discharge is performed. As shown in FIG. 15, when as much current as flows in even-numbered scanning electrodes $Y_{2N}$ does not flow in odd-numbered scanning electrodes $Y_{2N+1}$, the current flow is formed by X-electrodes. In the opposite case, the current supply path is formed by X-electrodes.

Figure 16:
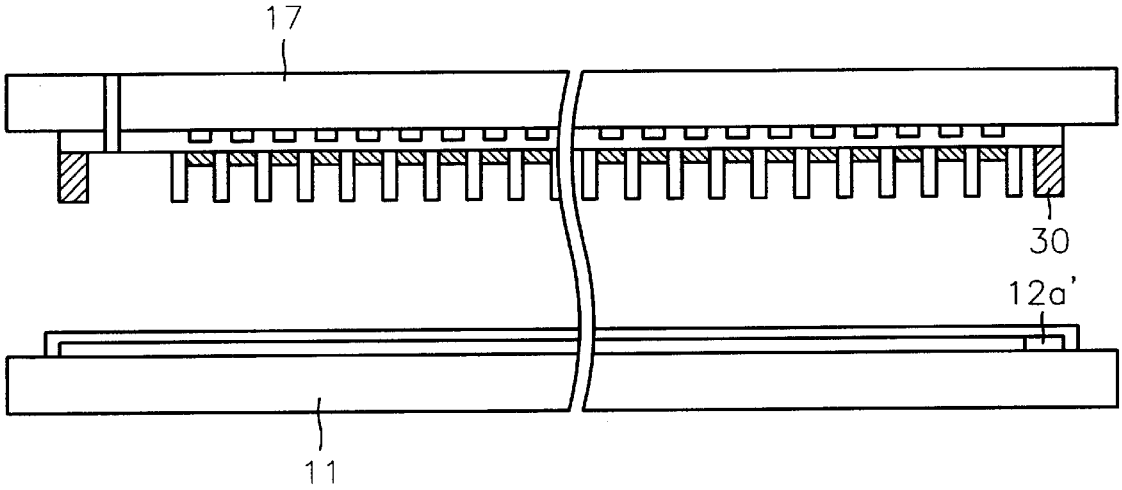
FIG. 16 is a cross-sectional view of a PDP according to the present invention.

FIG. 16 is a cross-sectional view of a PDP according to the present invention. The electrode in the non-luminous area at the right end of the drawing is a wiring portion 12*a*" of common electrodes. FIG. 16 shows the cross section of the panel viewed in a direction parallel to an address electrode after cutting away the panel in a direction parallel to discharge sustaining electrodes. As shown in FIG. 16, the wiring portion 12*a*" of the common electrodes formed on the front glass substrate 11 is positioned on a frit glass 30, thereby attaining an area as wide as possible and minimizing the non-luminous area in the panel.

Figure 17:
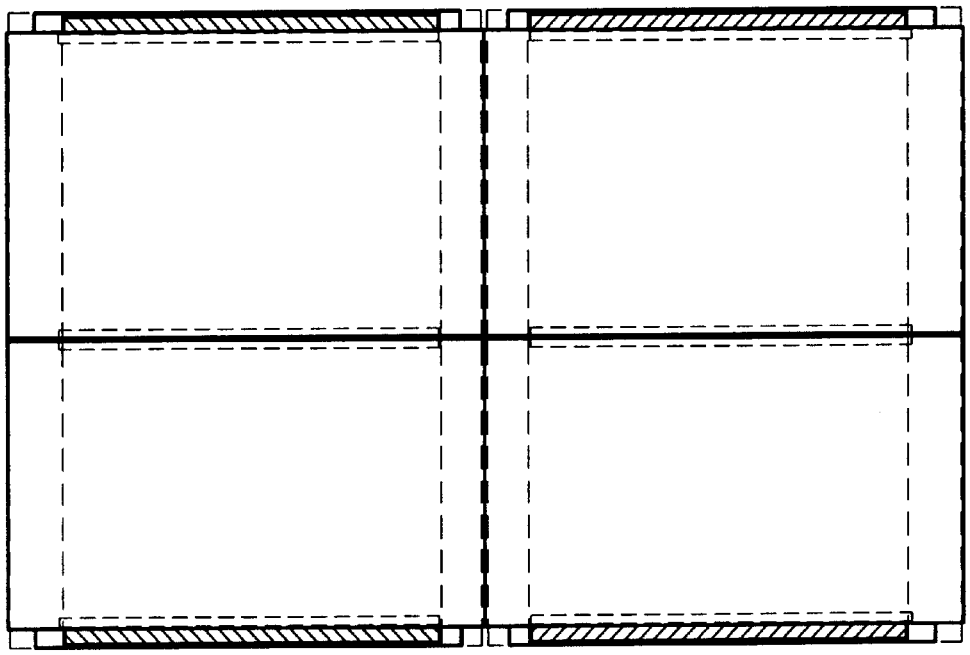
FIG. 17 (PRIOR ART)
FIG. 17 illustrates the screen of a PDP formed by connecting four conventional coplanar display panels.

FIG. 17 illustrates the screen of a PDP formed by connecting four conventional coplanar display panels. As shown in FIG. 17, a wide non-luminous area is produced by the connection terminals of the common (X) electrodes. Thus, a crossed non-luminous area unnecessarily shields a screen in the central portion of the screen (panel).

Figure 18:
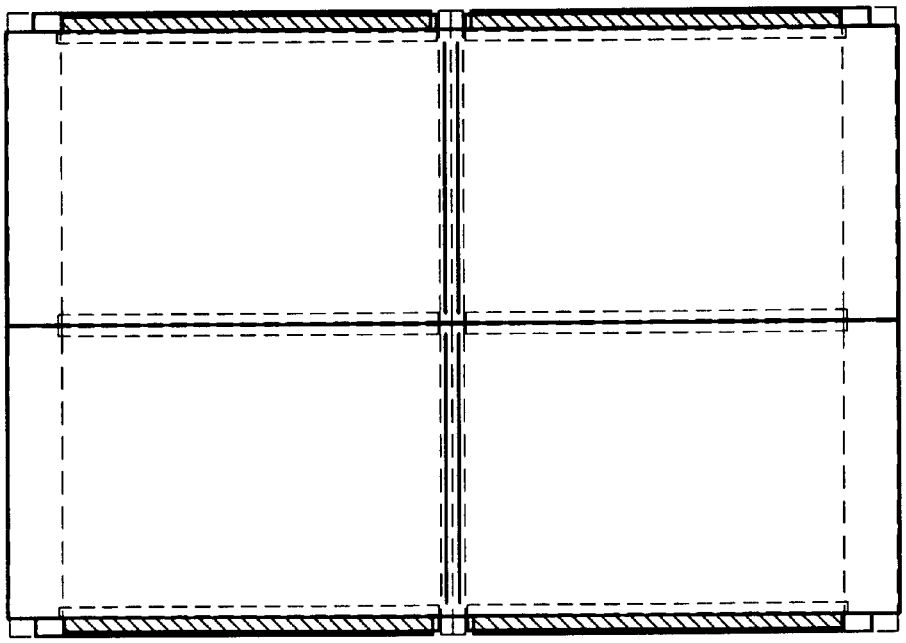
FIG. 18 illustrates the screen of a PDP formed by connecting four display panels according to a third embodiment of the present invention, shown in FIG. 11.

FIG. 18 illustrates the screen of a PDP formed by connecting four display panels according to a third embodiment of the present invention, shown in FIG. 11. Referring to FIG. 18, the non-luminous area in the PDP shown in FIG. 18 is much smaller than in FIG. 17.

Figure 19:
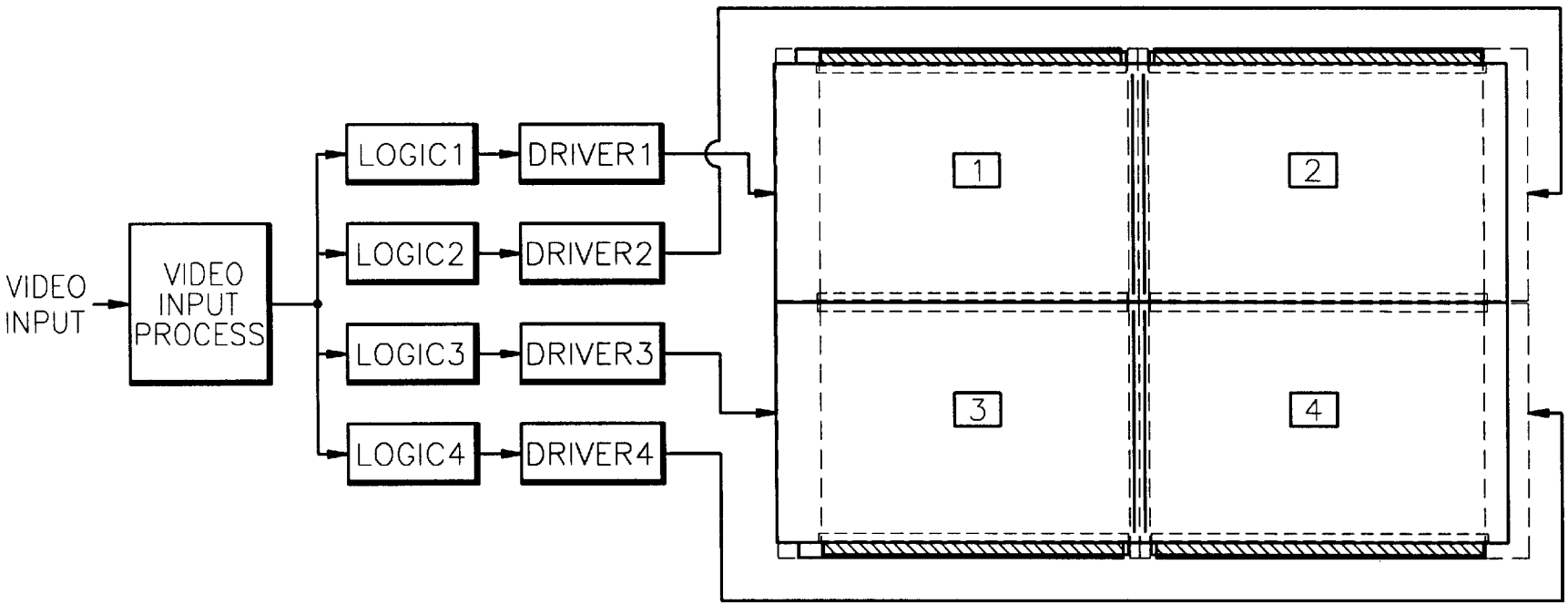
FIG. 19 is a block diagram schematically illustrating a driving apparatus for the PDP shown in FIG. 18.

FIG. 19 is a block diagram schematically illustrating a driving apparatus for the PDP shown in FIG. 18. As shown in FIG. 19, since four panels have different configurations, respective logics, and video input processing and driving circuits must be independently operated for the purpose of displaying an image.

As described above, in the PDP with improved energy recovery efficiency according to the present invention, connection terminals between scanning/common electrodes and external driving circuits are formed only at a non-luminous area at one end of a front glass substrate of a three-electrode face discharge PDP, with the non-luminous area of the other end greatly reduced, positive and negative discharge sustain pulses are alternately applied to an even-numbered scanning electrode and an odd-numbered scanning electrode, both electrodes are adjacent to each other, thereby suppressing an increase in impedance caused by the non-luminous area. According to this electrode structure, since the FPC connecting work for connecting a panel and a driving board can be lessened by half, the operation load and errors can be reduced. Also, when a discharge sustain pulse is applied, in contrast with the prior art in which the flow of current is of a coil type in a large closed loop embracing a driving board, a frame and a panel, in the present invention, the current is made to flow through two adjacent discharge sustaining electrodes in opposite directions, thereby offsetting electromagnetic fields generated by the current flow, resulting in minimizing EMI due to a discharge. Further, since discharge sustain pulses having opposite polarities are applied to different neighboring lines, the equivalent capacitance values of the panel are rearranged on the driving board in series, unlike the parallel arrangement of prior art. Thus, the overall equivalent capacitance value of the present invention panel is reduced to one fourth, compared to the prior art. This increases the energy recovery efficiency to 90% or higher.

Also, the portion of common (X) electrodes to which a little current flows, is made slim, thereby facilitating manufacture of stack-type PDP applications of four panels. For example, a 100-inch PDP can be manufactured by using four 50-inch PDPs without a non-luminous area in the central portion of the screen.

What is claimed is:

1. A method of driving a PDP having front and rear substrates opposed to and spaced apart from each other to maintain a discharge space, discharge sustaining electrodes having pairs of parallel, striped scanning lines and common lines on the front substrate, address electrodes arranged on the rear substrate orthogonally to the discharge sustaining electrodes, and a frit portion for hermetically sealing edges of the front and rear substrates, wherein a common connection line for connecting the common electrodes to each other is formed at a periphery at one end of the front substrate, and external connection terminals, where a plurality of common electrodes constituting an electrode group are simultaneously connected to the outside, the extending connection terminals extending from each of the plurality of common electrodes, are formed at the exposed portions of the other ends of the front substrate, at which the external connection terminals where the scanning electrodes are connected to the outside, are formed, the method comprising the step of driving the scanning electrodes by each two adjacent lines, wherein positive and negative discharge sustain pulses are alternately applied to two even-numbered driven lines, and a discharge sustain pulse having an opposite polarity to the two even-numbered driven lines is applied to two odd-numbered driven lines in synchronization with the discharge sustain pulses applied to the two even-numbered driven lines.

2. The method according to claim 1, wherein, when a sustained discharge is performed by the two even-numbered driven lines and the two odd-numbered driven lines, a difference in the potential therebetween is 2 times the voltage of the discharge sustain pulse.

3. The method according to claim 1, wherein, when a sustained discharge is performed by two even-numbered driven lines and two odd-numbered driven lines, the potential of the common electrodes is an intermediate level of the voltages of the discharge sustain pulses applied to the two even-numbered driven lines and the two odd-numbered driven lines.

* * * * *